United States Patent [19]

Gill

[11] 4,162,639

[45] Jul. 31, 1979

[54] LOAD INDICATING NUT WRENCH

[75] Inventor: Peter J. Gill, Wolverhampton, England

[73] Assignee: G.K.N. Fasteners Limited, West Midlands, England

[21] Appl. No.: 795,897

[22] Filed: May 11, 1977

[51] Int. Cl.[2] ..... B25B 23/14

[52] U.S. Cl. ..... 81/52.4 R

[58] Field of Search ..... 81/52.4 R, 57.38, 52.5; 173/11, 12, 15

[56] References Cited

U.S. PATENT DOCUMENTS

| | | | |
|---|---|---|---|
| 3,645,341 | 2/1972 | Amtsberg et al. | 81/52.5 |
| 3,877,326 | 4/1975 | Kock et al. | 81/57.38 |
| 3,969,960 | 7/1976 | Pagano | 81/52.4 R |
| 4,047,456 | 9/1977 | Scholz | 81/57.38 |

FOREIGN PATENT DOCUMENTS

| | | | |
|---|---|---|---|
| 1370792 | 10/1974 | United Kingdom | 81/52.5 |

*Primary Examiner*—James L. Jones, Jr

*Attorney, Agent, or Firm*—Spencer & Kaye

[57] ABSTRACT

Method and apparatus for tightening a nut and bolt assembly to ensure that the bolt shank is tensioned correctly using a wrench having two relatively movable detector parts carried by the body of the wrench, one part being a cylindrical outer casing which engages the abutment surface non-rotatably, the other part being a stem extending axially from the body and having its outer end engaging the body of the nut and its inner end connected to a holder for a microswitch arranged to cooperate with an actuating member fixed to said outer casing, said microswitch being in an electrical circuit which controls power to the wrench and/or a visible or audible signal.

2 Claims, 3 Drawing Figures

LOAD INDICATING NUT WRENCH

BACKGROUND OF THE INVENTION

1. Field of the invention

It is well known and accepted that to achieve maximum efficiency in a nut and bolt fastening it is necessary to tighten the nut and bolt assembly to such an extent that the tension generated in the bolt shank reaches and preferably exceeds a certain predetermined minimum. This is particularly important in certain applications such as high strength bolting connections and also in nut and bolt fastenings used in the aircraft and automobile fields where it is essential to ensure that nut and bolt assemblies are correctly tightened and that there shall be no slackening of the connection under working conditions where the nut and bolt assembly is subjected to vibrations and other fluctuating stresses.

2. DESCRIPTION OF THE PRIOR ART

There have been proposals for certain forms of nuts and washers which are termed "load indicating nuts or washers" in which the nut or washer is so formed that when tightened in a nut and bolt assembly and when the tension in the shank of the bolt reaches or exceeds a predetermined minimum value a portion or portions of the nut or washer become plastically deformed, the deformation being such as to give a detectable indication in such a way that it can be known that the desired minimum tension in the bolt shank has been reached or exceeded.

The present invention is concerned with the type of load indicating nut or washer wherein the aforesaid deformation results in a movement of part of the nut or washer towards the abutment surface against which a nut is being tightened. In the case of a load indicating nut the abutment surface could be the surface of the work or, if there is a normal load bearing washer under the nut then the abutment surface could be the outer surface of the washer. Likewise in the case of a load indicating washer being used with a conventional nut the abutment surface could again be the surface of the work or, if there is a normal load bearing washer being used under the load indicating washer than the abutment surface could be the outer surface of such load bearing washer.

Hereinafter for convenience of terminology the expression "load indicating element" is to be taken as referring to either a load indicating nut as such or a load indicating washer as such except where the context otherwise specifies. Thus the expression "load indicating element of the type specified" means a load indicating nut or load indicating washer of the type above defined.

An example of a load indicating nut of this type is disclosed in out prior British Specification 1.370.792 in which the part of the nut which undergoes plastic deformation is an annular flange at the end of the nut which engages the abutment and when such plastic deformation takes place there occurs a reduction in the overall axial height of the nut measured between a datum point on the nut body and the abutment surface against which the nut is being tightened. However, with this type of load indicating element there is a requirement to check that the desired amount of deformation has taken place and this involves a separate inspection operation using a gauge such as the "clock" gauge disclosed in the aforesaid patent specification. Other proposals for this type of load indicating element also generally require subsequent inspection and checking with some form of gauge.

SUMMARY OF THE INVENTION

One object of the invention is to provide a method of tightening a nut and bolt assembly using a load indicating element in the assembly in such a manner as to ensure that the desired minimum tension in the bolt shank is reached or exceeded and the bolt shank therefore correctly tensioned.

According to the present invention there is provided a method of tightening a nut and bolt assembly, which assembly includes a load indicating element of the type specified, so as to ensure that the bolt shank is tensioned correctly, comprising; applying tightening torque to the nut whilst simultaneously applying, to the body of the load indicating element, detector means to detect and respond to change in distance between two preselected datum points on the element and continuing application of tightening torque until said detector means has responded to a change in distance between said datum points of a predetermined value.

Where a load indicating washer is being used with a conventional nut in a nut and bolt assembly then the expression element in the foregoing and in the following claims is to be interpreted in this sense. The element may be the body of the washer in which case the two datum points above referred to will be on the washer itself or the two datum points may be one on the body of the conventional nut and one on the load indicating washer in which case the combined assembly of conventional nut and load indicating washer is to be regarded as being the element.

A further object of the invention is to provide apparatus for carrying out the above method.

Accordingly we provide apparatus for tightening a nut and bolt assembly including a load indicating element of a type in which a portion undergoes plastic deformation at a predetermined loading, the apparatus comprising a wrench having a body with means to apply tightening torque to the nut when the body is rotated, detector means carried by the wrench body and having two relatively movable detector parts, at least one of which engages the body of the load indicating element, and which detector parts are held in predetermined positions relative to one another when the nut has been initially tightened against the abutment surface, and a signal device carried by the wrench body and operatively associated with said detector means and which operates to produce a signal when there has occurred a change of predetermined value in the relative positioning of said two detector parts, consequent upon further tightening of the nut and bolt assembly beyond said initial tightening to said predetermined loading.

The two detector parts may engage the body of a load indicating nut at relatively spaced positions or in the case where a load indicating washer is being used with a conventionl nut one detector part may engage the conventional nut whilst the other detector part engages the load indicating washer instead of both parts engaging the body of the load indicating washer at relatively spaced positions.

However, it has been found more convenient in practice to construct the wrench so that one detector part may engage the abutment surface whilst the other detector part engages the body of the load indicating nut.

The "initial tightening" of the nut means the position which is reached when the nut has been run on to the end of the bolt and tightened down such that all "clearance" is taken up and the position has been reached whereafter further tightening would start to create tension in the bolt shank.

Whilst the invention may be applied to the case of a manually operated wrench it is envisaged that in practice the invention will find most application in the case of power operated wrenches. A preferred form of signal device is an electrical one incorporating means such as a micro-switch controlling an electrical circuit such that upon actuation of the signal device the micro-switch operates to open or close an electrical circuit or send a signal via an electrical circuit to initiate means giving a positive indication that the nut has been tightened correctly. Such positive indication may be the production of an audible or visible signal or as in the preferred form the positive cessation of the power supply to a power operated wrench.

An embodiment of the invention is illustrated by way of example in the accompanying drawings wherein:

DESCRIPTION OF PREFERRED EMBODIMENTS

Figure 1:
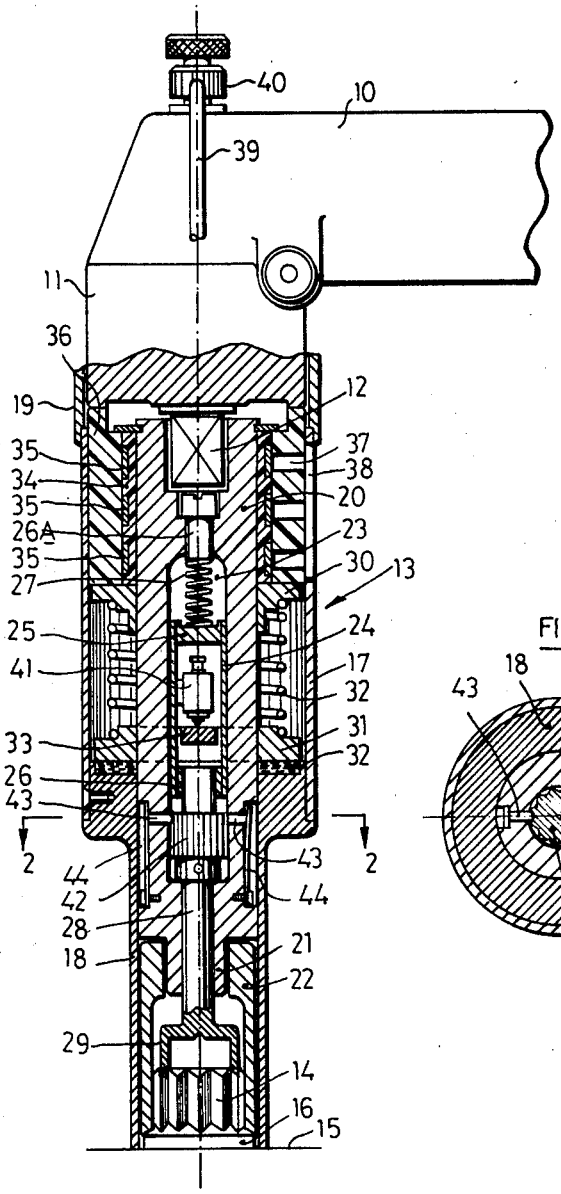
FIG. 1 is a verticl cross-section through a wrench according to the invention shown attached to the operative end of a normal power operated wrench and FIG. 2 is a section on the line 2—2 of FIG. 1.

In FIG. 1 of the drawings 10 indicates the forward end of a normal power operated wrench such as an air operated wrench and at the end the extension 11 at right angles to the normal axis of the main body of the wrench and from which projects the rotating wrench part 12 which normally fits into the socket of a socket wrench part for applying tightening torque to conventional nuts in the ordinary way. The wrench according to the present invention is indicated generally by reference numeral 13 and is attached to the extension part 11 of a normal wrench. The wrench 13 is shown as applied to the tightening down of a load indicating nut 14 against an abutment surface 15 and the load indicating nut being of the type specified such as, for example, a nut as described in our prior specification aforesaid having a base flange 16 which undergoes plastic deformation when the nut is being tightened to induce tension in the bolt shank of the complete nut and bolt assembly.

The wrench 13 comprises an outer cylindrical casing 17 to the lower end of which is secured a co-axially arranged bearing sleeve 18 which is of reduced diameter as compared with the casing 17 and at its upper end the casing 17 is secured to a cylindrical collar 19 which engages slidably around the extension part 11 of the normal wrench. The casing 17 is attached to the wrench 10 by a stirrup, part of one leg of which is shown at 39, secured to the wrench 10 by clamp screw 40 and the attachment is such that the casing 17 is prevented from rotating relative to the part 11 but is capable of axial sliding movement relative to the part 11. The casing 17 forms part of the aforesaid detector means and the lower end of the bearing sleeve 18 forms one of the two detector parts aforesaid.

Within the casing 17 is co-axially disposed the main body 20 which is of a generally cylindrical configuration and has at its upper end an axially aligned socket of non-circular cross-section to be engaged non-rotatively with the wrench part 12 projecting from the extension 11 of the conventional wrench whereby the body 20 is rotated. At its lower end the body 20 has an axial extension 21 also of non-circular cross-section to engage non-rotatively with the opening of corresponding cross-section in the upper end of a normal socket wrench part 22 which engages at its lower end with the nut 14 to apply tightening torque thereto.

The body 20 has an elongated slot 23 extending diametrically therethrough and over a substantial part of the intermediate portion of its length and slidably mounted within the slot 23 is a micro-switch holder comprising spaced apart side plates 24 connected at their upper ends by a cross-piece 25 and at their lower ends by an internally threaded block 26. The upper end of slot 23 communicates with an axially extending internally threaded hole in which is engaged a screw 26A and a spring 27 is disposed between the inner end of screw 26A and the upper face of the cross-piece 25 so as to urge the micro-switch holder downwardly in relation to the body 20.

At its lower end the slot 23 communicates with an axially extending circular cross-section opening extending through to the bottom of the extension 21 and slidably mounted within this opening is a stem 28 which at its upper end is in screw-threaded engagement with the block 26 and at its lower end is formed as a part-cylindrical shoe 29 which engages the upper end face of the nut 14 when the wrench 13 is in position. The shoe 29 constitutes the second detector part of the detector means.

Also within the casing 17 an annular flange 30 is secured to the body 20 and lower down within the casing 17 a further annular flange is mounted slidably about the body 20. A coil spring 32 has its ends located upon annular extensions of the two flanges 30 and 31 and extends between the said two flanges and the underside of the lower flange 31 bears upon a self lubricating bearing ring 32 resting upon the upper enlarged end of the sleeve 18.

The annular flange 31 has, at two diametrically opposed positions which are in line with the slot 23, pair of recesses and the ends of a bar 33 are secured in these recesses so that the bar extends through the slot 23; thus diametrically through the body 20.

At its upper end the body 20 has fitted thereto a sleeve 34 formed of electrically insulated material (e.g. nylon) and this sleeve rotates with the body 20 when it is driven from the wrench 10. Set into the circumference of the sleeve 34 are three spaced apart metal rings 35 of electrically conducting material and these serve as brush rings for conducting electric current as hereinafter explained. The sleeve 34 rotates within a cylindrical member 36 also formed of electrical insulating material and at one side the sleeve 36 has three radial bores 37 which are for the purpose of receiving brush holders having brushes to make electrical connection with the three brush rings 35. The brush holders (not shown) in the bores 37 align with an elongated slot 38 in the outer casing and a single cable (not shown) housing the leads from the brush holders connects with an electrical control circuit hereinafter referred to. Carried within the micro-switch holder by being attached to one of the side plates 24 is a change-over micro-switch 41 and suitable electric leads from the switch 41 (not shown) pass upwardly through a channel in the body 20 and make electrical connection with the inner faces of of the three brush rings 35.

The operating plunger projecting from the base of the micro-switch 41 is in engagement with the bar 33 extending through the slot 23 and the distance moved by the plunger to actuate the micro-switch contacts can be adjusted by the following described mechanism.

Figure 2:
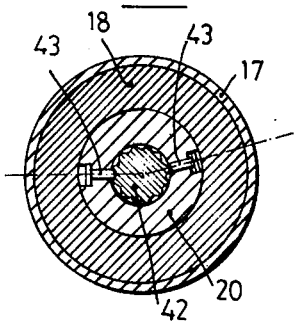

At its upper end and below the screw-threaded part the stem 28 has fitted thereto an adjusting nut 42 which as shown in FIG. 2 has a serrated or toothed exterior to be engaged by a pair of spring loaded detents 43. The detents 43 are engaged by the upper ends of a pair of leaf springs 44 set into axially extending channels on the exterior of the body 20 and secured at their lower ends to the body 20 by suitable screws.

As shown in FIG. 2 the detents 43 are not diametrically opposed but are on lines at an obtuse angle so that when one detent 43 is engaged in the valley between two teeth the other detent 43 is engaging the extremity of a tooth. The purpose of this arrangement of the detents 43 is to enable a controlled step by step rotational movement being imparted to the stem 28 by turning the end formed as the shoe 29 and thus by virtue of the screw-threaded connection between its upper end and the block 26 the micro-switch holder can be moved upwardly or downwardly in relation to the stem 28, thus adjusting the distance which the micro-switch plunger has to move to actuate the contacts of the micro-switch. It will be appreciated that the amount of movement of the plunger is very slight; of the order of a few thousandths of an inch.

The micro-switch 41 can be used as a simple on/off switch in which case only two of the brush rings 35 would be utilised or the micro-switch can be used as a change-over switch and all three brush rings utilised. Whichever mode of use is adopted the operation of the micro-switch causes breaking of an electrical circuit or the generation of a signal in an electrical circuit including the micro-switch and this in turn can be utilised through the medium of generally known mechanisms to cut off the power supply to the wrench 10 and/or light a signal lamp or actuate an audible signal. In addition the signal from the micro-switch may be fed into a computer store together with the date, time and other data to give a record of every nut tightened during a working day and thus relate each nut to a particular batch or unit manufactured. This provides a solution to the growing requirement for complete monitoring and recording of fastener functioning in areas where safe and efficient bolted connections are essential.

In the position of the parts shown in FIG. 1 of the drawings the nut has been initially tightened and with the wrench applied thereto the sleeve 18 is making contact with the abutment surface 15 and the shoe 29 making contact with the upper surface of the nut 14. In this position the relationship between the operating plunger of the micro-switch 41 and the bar 33 is such that the plunger needs to move a certain distance (say about 0.015 inch) in order to cause the micro-switch contacts to be operated. Depending upon the size and load capacity of the nut to be tightened the aforesaid distance to be moved can be adjusted by rotation of the stem 28 as above described to adjust the positional relationship between the micro-switch and the bar 33.

Because of the engagement of the sleeve 18 with the abutment surface 15 the bar 33 is held in a fixed position in relation to the abutment surface 15 and as further torque is applied by the wrench after initial tightening, the application of further torque generates tension in the bolt shank and plastic deformation of the flange 16 of the nut in the manner described in our aforesaid British specification with the result that the body 20 and shoe 29 at the bottom of the stem 28 move downwardly due to the decrease in overall height of the body of the nut 14 with the result that the micro-switch holder is also moved downwardly carrying with it the micro-switch until the predetermined distance of 0.015 inches (for example) has been traversed whereupon the micro-switch 41 is operated.

Figure 3:
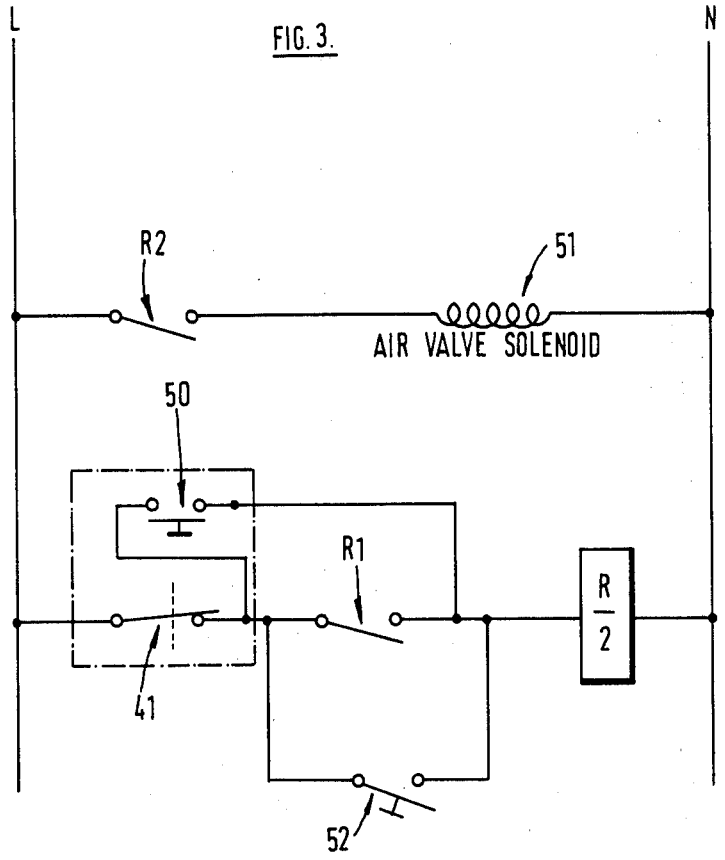
FIG. 3 is a circuit diagram of one form of electrical circuit.

FIG. 3 is a circuit diagram illustrating a simple control circuit of conventional type which, on opening of the micro-switch, shuts off the air supply to the driving air motor of the tool. Similar circuitry may be adapted to switch off an electrically operated tool or to operate a visual or audible warning signal to the operator.

R/2 is a relay having contacts R1 and R2. The part of the circuit indicated by the chain dotted boundary lines is mounted on the tool.

The operator first places the tool in position with the shoe 29 resting on the nut 14 as described above. Micro-switch 41 is closed, since the nut is initially undeformed. The operator presses the re-set button 50 which makes the circuit through the relay R/2, automatically closing the contacts R1 and R2. R1, once closed, provides an alternative route for current to the relay and hence holds the relay on when the re-set button 50 is released. Contacts R2, when closed, energise the air valve solenoid which connects the air supply to the motor of the tool. The tool can then be controlled normally by the operator until the load indicating nut 14 becomes deformed by the predetermined amount, which opens micro-switch 41.

Opening of micro-switch 41 breaks the circuit through the relay R/2, thereby de-energising it and opening the contacts R1 and R2. Contact R2 acts to de-energise the air valve solenoid 51 and cuts the air supply to the tool, irrespective of whether the operator is, at that time, using the normal tool operating controls. Contacts R1 ensure that, should the micro-switch momentarily close again, the circuit will not be remade without operation of the re-set button 50.

An additional switch 52 may also be provided which takes no part in the normal operation of the tool, being normally open. Closure of the switch is equivalent to continuous operation of the re-set 50 and enables the tool to be repeatedly cycled for testing or re-setting purposes only.

As explained in more detail in our aforesaid prior British specification once the desired minimum tension has been generated in the bolt shank and plastic deformation of the flange 15 commences, there occurs plastic flow of the metal at substantially constant load and tightening can be carried on further until any point is reached in the range wherein this plastic deformation continues at substantially constant load. Thus, there is substantial degree of latitude available to the operator to ensure that he has tightened the nut down to achieve and exceed the desired tensile load in the bolt shank.

After completing the tightening operation the nut may be checked with a gauge also as described in the aforesaid prior specification.

I claim:

1. A load indicating wrench for tightening a nut and bolt fastener assembly, which assembly includes a load indicating element and a bolt having a shank, and presents two contact datum points, said element being of a type in which a portion of the element undergoes plastic deformation when the bolt shank reaches a predetermined tension during tightening of the assembly, such plastic deformation resulting in a reduction in a dimension of the assembly measured in the direction axially of the bolt shank, and a corresponding change in the distance between the two contact datum points, said wrench comprising, in combination: first detecting means composed of an outer casing having an end wall engaging one datum point when the wrench engages the assembly; torque applying means within said casing for engaging the assembly to apply torque thereto; second detecting means centrally located within said casing and composed of a member contacting the second datum point when the wrench engages the assembly and axially movable within said casing; and signal generating means composed of a mechanically operated switch having two parts movable relative to one another into signal generating switching position, one part of said switch being fixed relative to said casing and the other part of said switch being movable with said member for causing said switch to reach its signal generating position when such reduction in the dimension of the assembly reaches a value at which a selected distance exists between the two contact datum points.

2. A load indicating wrench according to claim 1 wherein said outer casing is of generally cylindrical form, said torque applying means comprises a body of generally cylindrical form and mounted coaxially within said outer casing so as to be rotatable therein about the common central axis, and said second detecting means comprises a stem extending axially and slidably from the body and having at its outer end a shoe which constitutes said member and which engages a top surface of the load indicating element.

* * * * *